US008733253B1

(12) United States Patent
Norman et al.

(10) Patent No.: US 8,733,253 B1
(45) Date of Patent: May 27, 2014

(54) FOOD PREPARATION TABLE

(76) Inventors: Edwin J. Norman, Dubuque, IA (US); Eric E. Norman, Dubuque, IA (US); Ryan M. Norman, Dubuque, IA (US); Michael J. Pichetto, Easton, PA (US); Domenic Albenese, Easton, PA (US)

( * ) Notice: Subject to any disclaimer, the term of this patent is extended or adjusted under 35 U.S.C. 154(b) by 0 days.

(21) Appl. No.: 13/191,372

(22) Filed: Jul. 26, 2011

Related U.S. Application Data

(60) Provisional application No. 61/367,599, filed on Jul. 26, 2010.

(51) Int. Cl.
*A47B 85/00* (2006.01)

(52) U.S. Cl.
USPC ..... 108/24; 108/25

(58) Field of Classification Search
USPC ..... 108/44, 26, 25, 50.18; 312/228.1, 236; 4/631
See application file for complete search history.

(56) References Cited

U.S. PATENT DOCUMENTS

| | | | | | |
|---|---|---|---|---|---|
| 1,492,428 | A | * | 4/1924 | Cook | 108/24 |
| 1,513,357 | A | * | 10/1924 | Webber | 126/268 |
| 1,653,809 | A | * | 12/1927 | Lane | 108/24 |
| 1,821,303 | A | * | 9/1931 | Hamilton, Jr. | 108/24 |
| 2,157,786 | A | * | 5/1939 | Coordes | 4/632 |
| 2,314,157 | A | * | 3/1943 | O'Brien | 4/631 |
| 3,093,836 | A | * | 6/1963 | Christensen et al. | 108/24 |
| 3,444,565 | A | * | 5/1969 | Anklin | 4/637 |
| D306,100 | S | * | 2/1990 | Wende | 108/24 |
| 5,367,959 | A | * | 11/1994 | Allen et al. | 108/23 |
| 5,915,851 | A | * | 6/1999 | Wattrick et al. | 4/619 |
| 6,349,715 | B1 | * | 2/2002 | McBroom | 126/276 |
| 7,207,074 | B1 | * | 4/2007 | Stewart | 4/637 |

* cited by examiner

*Primary Examiner* — Jose V Chen
(74) *Attorney, Agent, or Firm* — Hamilton IP Law, PC; Jay R. Hamilton; Charles A. Damschen

(57) ABSTRACT

A food preparation table for cutting food articles and household items includes a cutting surface for cutting articles thereon. The preparation table further includes a smooth, sloping trough near one or many edges of the cutting surface. The trough or troughs may utilize a system of nozzles that flush debris from the trough into a cavity, or removable receptacles. Additional embodiments may include storage compartments positioned under the work surface for ease of food preparation. Further embodiments may utilize multiple configurations to enhance preparation efficiency.

10 Claims, 12 Drawing Sheets

FOOD PREPARATION TABLE

CROSS-REFERENCE TO RELATED APPLICATIONS

Applicant claims priority from provisional U.S. Pat. App. No. 61/367,599 filed on Jul. 26, 2010, which is incorporated by reference herein in its entirety.

FIELD OF THE INVENTION

The present invention relates to a device for food preparation. More specifically, the present invention provides a food preparation table equipped with troughs that may include nozzles for a pressurized fluid flushing system.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

This invention relates generally to food processing. The present invention relates more specifically to a food preparation/cutting table having a raised work surface and troughs for the collection of debris, which troughs include a flushing system that cleans the troughs.

It is known to provide a raised cutting surface for the preparation of food products (such as fish, meat, vegetables, fruits, etc). For example, U.S. Pat. No. Des. 283,777 shows a raised cutting board for use in food preparation.

During food preparation and specifically meat and/or fruit and vegetable trimming, cleaning, etc., waste is produced through cleaning methods. This waste must be removed to promote sanitary food preparation. What is needed therefore is a way to efficiently rid the cleaning surface and adjacent area of discarded material.

BRIEF SUMMARY

The food preparation table relates to a raised work surface with scrap troughs that remove waste through the use of flushing systems. The food preparation table may include any one or more of the following features:

(1) A complete ozone system; or
(2) L-shaped or straight design; or
(3) Sinks positioned on the left, right, or split in between the work surface; or (4) Fish file underneath; or
(5) Pan inserts for the trough; or
(6) Drain boards to the left, right, or split in between the work surface; or
(7) Under-table shelving; or
(8) Poly sink covers; or
(9) Debris collector or disposer system.

One embodiment of the food preparation table is a table for processing food products that may include a base, a raised preparation surface, at least one trough, at least one nozzle to clean the contents of the trough into a cavity, and/or a removable receptacle.

The food preparation table also relates to a raised work surface, which provides the operator a more ergonomic cutting position, and may include a flushing system in combination with receptacles that promote a sanitary cleaning environment. The flushing system circulates fluid through the trough and into a cavity. A control system permits independent control of each nozzle of the flushing system so that the user is able to increase the flow to frequently used sections of the trough(s), and/or reduce the flow to less frequently used sections of the trough(s).

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION - LISTING OF ELEMENTS

Figure 1A:
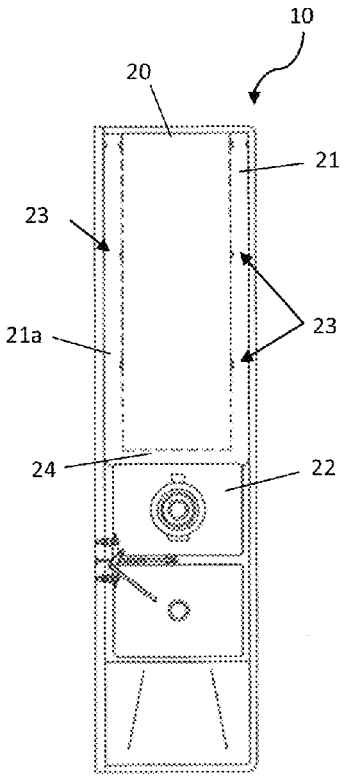
FIG. 1A is a schematic representation of an aerial view of one embodiment of a food preparation table having a peninsular-shaped work surface with troughs located to the front, back and left of the work surface.

| ELEMENT DESCRIPTION | ELEMENT # |
|---|---|
| Food preparation table | 10 |
| Work surface | 20 |
| Front trough | 21 |
| Rear trough | 21a |
| Cavity | 22 |
| Nozzle | 23 |
| Trough exit | 24 |
| Storage compartment | 25 |
| Frame | 26 |
| Extension | 28 |
| Receptacle | 30 |

DETAILED DESCRIPTION

Before the various embodiments of the present invention are explained in detail, it is to be understood that the invention is not limited in its application to the details of construction and the arrangements of components set forth in the following description or illustrated in the drawings. Each example is provided by way of explanation of the invention, not limitation of the invention. In fact, it will be apparent to those skilled in the art that various modifications and variations can be made in the present invention without departing from the scope or spirit of the invention. For example, features illustrated or described as part of one embodiment may be used on another embodiment to yield a still further embodiment. Thus, it is intended that the present invention cover the modifications and variations of this invention provided they come within the scope of any appended claims and their equivalents. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Figure 1B:
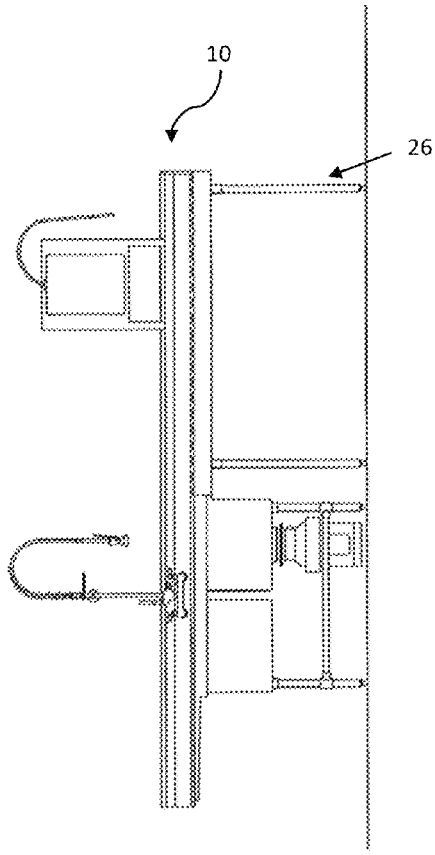
FIG. 1B is a schematic representation of a front-view of the food preparation table according to the embodiment of FIG. 1A.

One embodiment of a food preparation table 10 is shown in FIGS. 1A and 1B. The food preparation table 10 includes a work surface 20, having a durable, rigid, continuous, flat top surface. The work surface 20 is generally supported by frame 26, which may have infinite number of configurations and/or orientations depending on the layout of the food preparation table 10, as described in detail below for several disclosed embodiment thereof. In many embodiments of the food preparation table 10, the work surface 20 will be configured so that the user may perform any number of tasks thereon, including but not limited to cutting, rolling, tenderizing, and the like.

The work surface 20 may be formed of a substantially rigid, waterproof, non-or-minimally porous, heat-resistant, and durable material, preferably formed from injection molded food-grade plastic, which is anti-bacterial and sterilizable. According to an embodiment of the food preparation table 10, the work surface 20 may be formed from a variety of different materials that are approved for use in the food industry (such as plastics, acrylic, silicone, wood, stainless steel, etc).

The food preparation table 10 may also include a sloping surface region (or front trough) 21 formed on the forward side of the work surface 20. The food preparation table 10 may also include a rear trough 21*a* formed on the rearward side of the work surface 20 (i.e., adjacent a backsplash). It is contemplated that the rear trough 21*a* will be deeper and/or wider than the front trough 21 for most embodiments of the food preparation table 10. The surface of the troughs 21, 21*a* is substantially smooth and slippery. The smooth and slippery surface of the troughs 21, 21*a* aids in the transfer of chopped and discarded articles from the work surface 20 to another location (which may be a cavity 22, such as a sink or disposal). In the embodiments of the food preparation table 10 pictured herein, the troughs 21, 21*a* are configured to be at a lower elevation than the elevation of the work surface 20 by an amount of 0.1 to 3.0 inches. Additionally, in the pictured embodiments the width of the front trough 21 is approximately 3 inches, and the width of the rear trough 21*a* is approximately 4.5 inches. However, in other embodiments these dimensions may be different without limitation.

As shown in FIG. 1A, the food preparation table 10 may include in at least one trough 21, 21*a* an integral flushing system, for which nozzles 23 provide an exit port of a fluid. As noted, the troughs 21, 21*a*, extend along a portion or the entirety of the forward and rearwards sides of the work surface 20. A trough exit 24 may be fashioned adjacent the downstream terminus of each trough 21, as best shown in FIG. 1A, which trough exit 24 is described in further detail below.

Multiple embodiments of the troughs 21, 21*a*, 24 flushing system (including placement and/or orientation of nozzles 23), and work surface 20 configuration are known and shown generally in FIGS. 1A-9B and described in further detail herein. Each trough 21, 21*a*, 24 is generally formed with a downwardly inclined bottom surface that extends along the length of the trough 21, 21*a*. That is, the slope of the trough

21, 21*a* is designed so that fluid flows (as a result of gravitational force and/or fluid exiting the nozzles 23) from the top of the work surface 20 as oriented in FIG. 1A to the bottom thereof. As used herein, the term fluid may include a gas, vapor, or liquid substance. The fluid and/or debris may then flow into a trough exit 24, if present in that embodiment of the food preparation table 10, and into a cavity 22.

FIG. 1A provides a clear view of one embodiment of a trough exit 24 that may be fashioned adjacent the downstream terminus of each trough 21, 21*a*. The trough exit 24 may be formed substantially as another trough 21, 21*a* on the edge of the work surface 20 adjacent the cavity 25. In such an embodiment, as shown in FIG. 1A, the trough exit 24 may simply continue the downward slope of the troughs 21 so that debris and/or fluid continues to flow toward the cavity 25. The troughs 21, 21*a* and trough exit 24 are designed so that contents from the troughs 21, 21*a* empties into the trough exit 24, which in turn empties into a cavity 22 (which may be a sink, garbage disposal, refuse container, etc.) indicated generally at 22 in FIGS. 1A-9B. The purpose of the troughs 21, 21*a* is to provide a transfer mechanism. Discarded articles may be placed in the troughs 21, 21*a* for transfer to the cavity 22.

FIG. 1A shows a nozzle indicated generally at 23, which may be positioned in either trough 21, 21*a*. The nozzles 23 are configured to direct streams of fluid into a corresponding trough 21, 21*a*. Many different systems for delivery of fluid to the nozzles 23 and/or an outlet manifold fluidly connected to a plurality of nozzles 23 may be used with the food preparation table 10.

Accordingly, the specific type and/or configuration of the system for delivery of fluid to the nozzles 23 in no way limit the scope of the food preparation table 10.

In one embodiment of a system for delivery of fluid to the nozzles 23 that may be used with the food preparation table 10, a pump (not shown) draws fluid from a fluid supply (not shown) and delivers a portion of this fluid under pressure to the outlet manifold, or nozzle 23, by means of a fluid conduit (not shown), such as tubing or piping. Any fluid conduit suitable for the particular application may be used with the food preparation table 10, including but not limited to flexible hose, pipe, or combinations thereof (not shown). Additionally, the pressure of the fluid may be adjustable by the user in certain embodiments of the food preparation table 10. The pressure of the fluid may be controlled and/or adjusted through any method/structure suitable for the particular application of the food preparation table 10, including but not limited to control valves, orifices, and/or combinations thereof.

In the embodiments pictured herein, the fluid will issue from the nozzles 23 with sufficient force to move debris that has been emptied into the troughs 21, 21*a* from the work surface 20 along the length of the trough 21, 21*a* and finally, removed from the trough 21, 21*a* at the trough exit 24. As previously mentioned, the force and/or volume of the fluid issuing from the nozzles 23 may be adjusted by the user via a control valve (not shown) or other similarly functioning structure. It is contemplated that the user will adjust the force and/or volume of the fluid so that it is sufficient to carry this discarded material along the entire length of the trough 21, 21*a*, through the trough exit 24, and into the cavity 22. The specific number, location, spacing, and/or orientation of the nozzles 23 will vary from one embodiment of the food preparation table 10 to the next, and is therefore in no way limiting to the scope thereof. Furthermore, in certain embodiments of the food preparation table 10 several of those parameters (such as orientation and spacing) may be adjusted by the user during use.

Figure 2A:
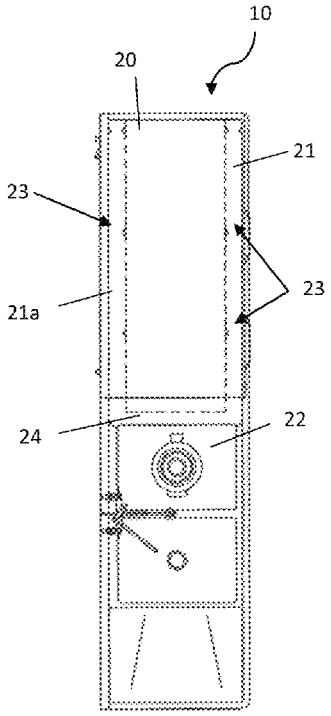
FIG. 2A is a schematic representation of an aerial view of a food preparation table having a peninsular-shaped work surface with troughs located to the front, back and left of the work surface also utilizing under-surface storage according to one embodiment.
Figure 2B:
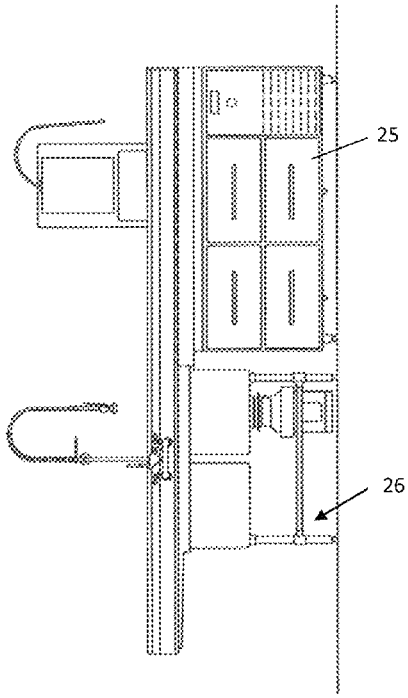
FIG. 2B is a schematic representation of a front-view of the food preparation table according to the embodiment of FIG. 2A.
Figure 3:
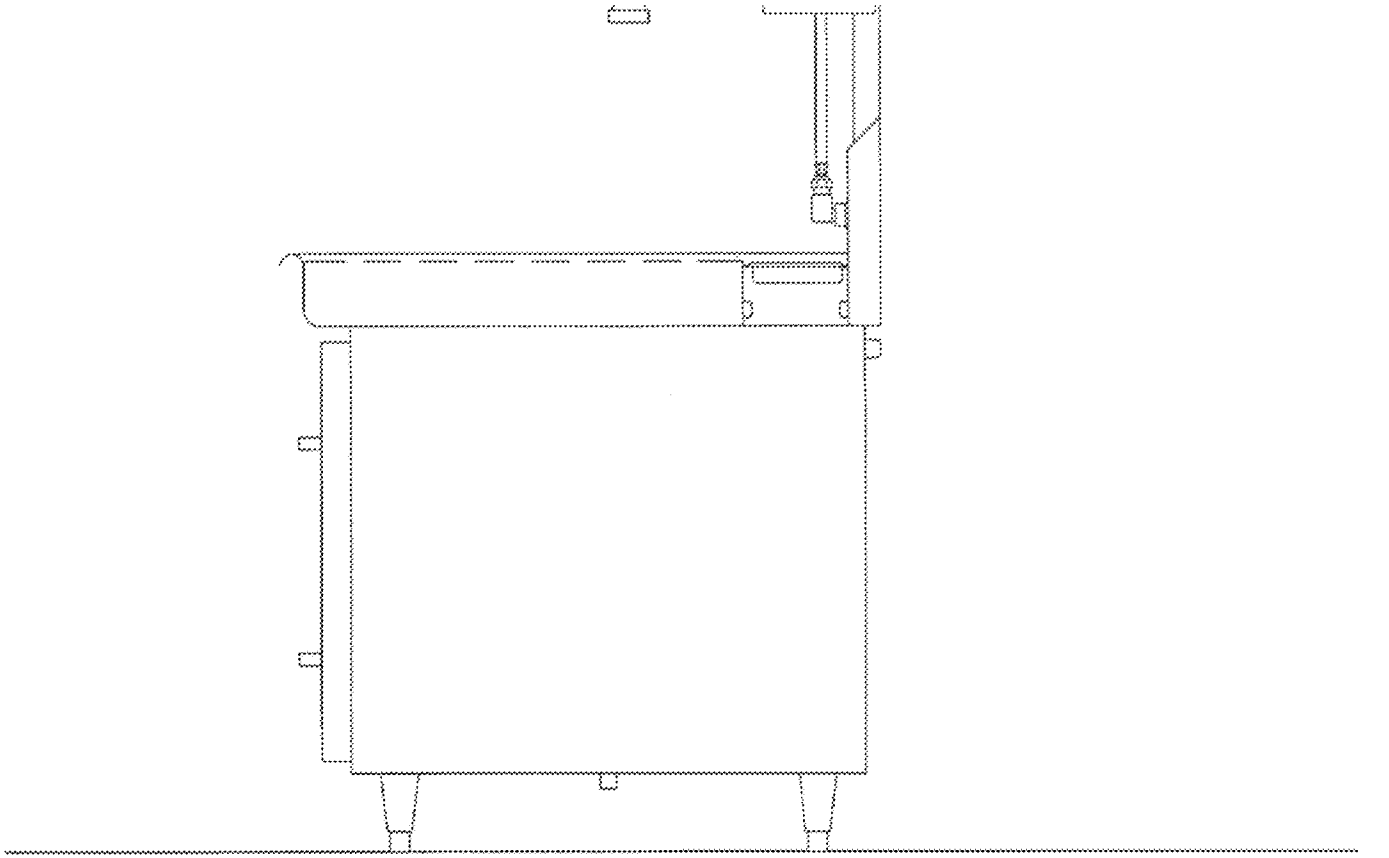
FIG. 3 is a schematic representation of a side view of a portion of the food preparation table according to the embodiment of FIG. 2A.

An alternative embodiment of the food preparation table 10 is shown in FIGS. 2A, 2B, and 3. The embodiment shown in these figures is similar to the embodiment as described and illustrated in FIGS. 1A and 1B. The embodiment of the food preparation table 10 shown in FIGS. 2A-3 includes troughs 21, 21*a* along the major length of each side of work surface 20, and a trough exit at the terminus thereof adjacent the cavity 22. In this embodiment, nozzles 23 are spaced along the length thereof of each trough 21, 21*a*. In the second embodiment storage compartments 25 are positioned under the work surface 20 on the front side of the food preparation table 10.

As with the first embodiment, a work surface 20 is supported by frame 26. However, the frame 20 in the embodiment pictured in FIGS. 2A, 2B, and 3 includes tracks and/or rails (neither shown) to support the storage compartments 25. In any embodiment pictured or described herein, storage compartments 25 may be formed as shelves, drawers, or the like, in which storage compartments 25 various atmospheric parameters within the interior of the storage compartment 25 may be controlled and/or adjusted. For example, it is contemplated that in one embodiment of the food preparation table 10, one storage compartment 25 may be heated and another cooled, wherein the specific temperature and humidity of each may be dictated by the user.

Figure 4A:
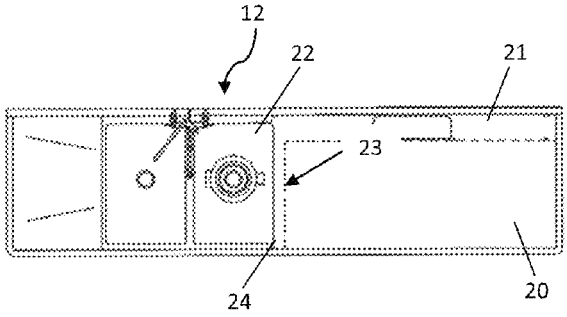
FIG. 4A is a schematic representation of an aerial view of a food preparation table with troughs located to the front and left side of the work surface.
Figure 4B:
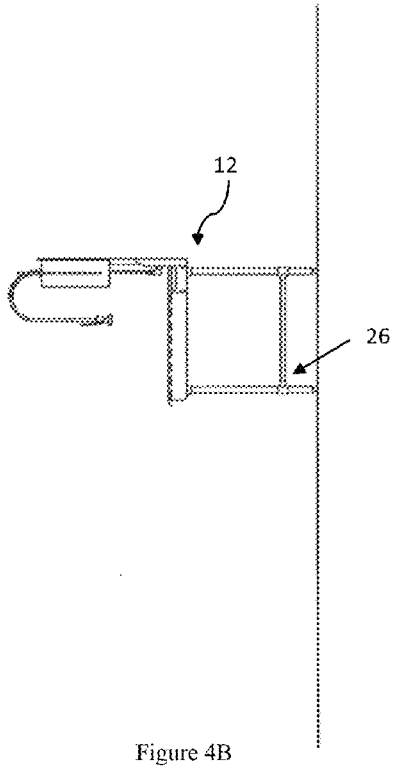
FIG. 4B is a schematic representation of a side view of a portion of the food preparation table according to the embodiment of FIG. 4A.

FIGS. 4A, and 4B show another embodiment of the food preparation table 10. This embodiment shows a work surface 20 with a rear trough 21*a* located on the rearward side of the work surface 20 and a trough exit adjacent the cavity 22. The rear trough 21*a* enters into the cavity 22 adjacent the trough exit 24 as in the previous embodiments described herein. A comparison of FIGS. 1A and 4A makes clear that the work surface 20 in the embodiment shown in FIG. 1A includes a front trough 21 along the forward side of the work surface 20, whereas the work surface 20 in the embodiment shown in FIG. 4A includes a rear trough 21*a* along only the rearward side of the work surface 20.

Figure 5A:
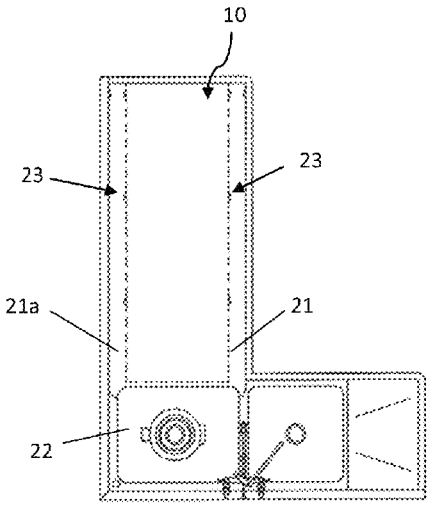
FIG. 5A is a schematic representation of an aerial view of a food preparation table having a peninsular-shaped work surface with troughs located to the front, back, and left of the work surface also utilizing an L-shaped design food preparation table according to one embodiment.
Figure 5B:
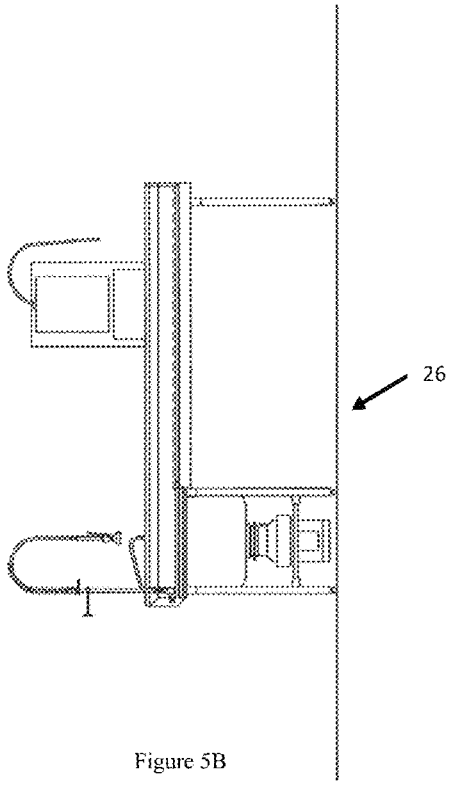
FIG. 5B is a schematic representation of a front-view of the food preparation table according to the embodiment of FIG. 5A.
Figure 6A:
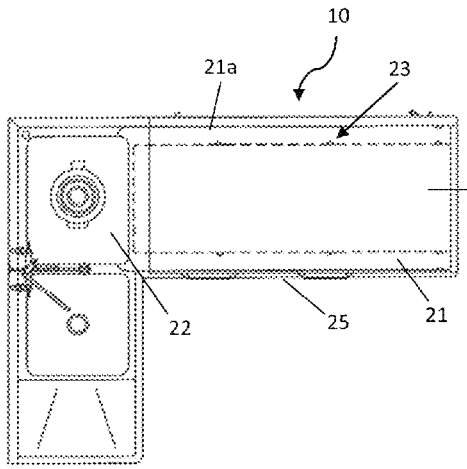
FIG. 6A is a schematic representation of an aerial view of a food preparation table having a peninsular-shaped work surface with troughs located to the front, back, and left of the work surface also utilizing an L-shaped design food preparation table with under-surface storage according to one embodiment.
Figure 6B:
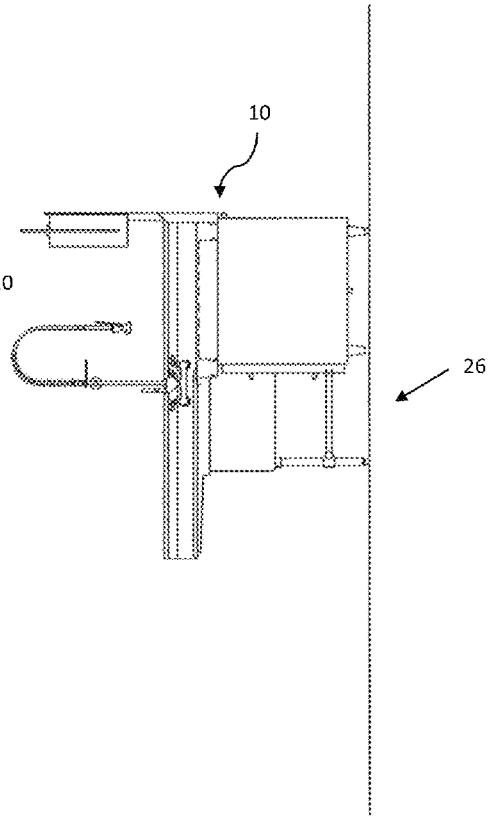
FIG. 6B is a schematic representation of a side view of a portion of the food preparation table according to the embodiment of FIG. 6A.
Figure 7:
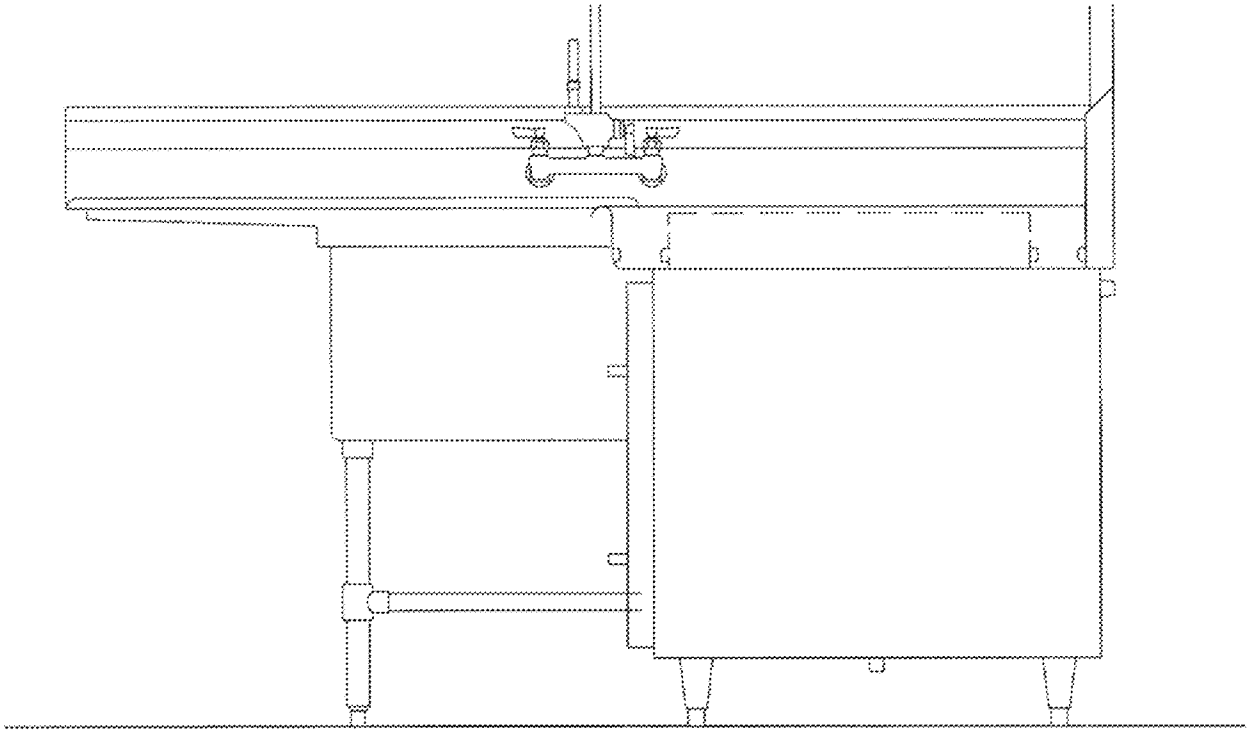
FIG. 7 is an enlarged view of the food preparation table according to the embodiment of FIG. 6B.
Figure 8:
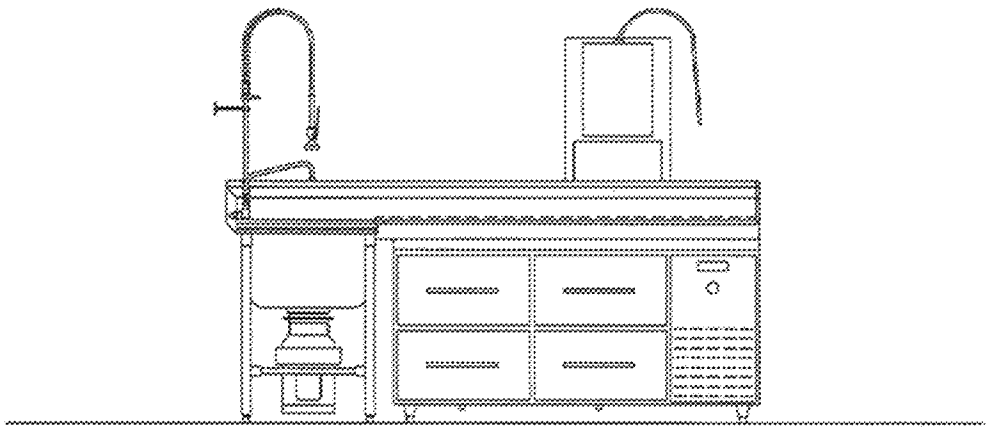
FIG. 8 is a schematic representation of a front-view of the food preparation table according to the embodiment of FIG. 6A.

Another embodiment of the food preparation table 10 is shown in FIGS. 5A and 5B. This embodiment shows an alternative arrangement of the food preparation table 10 wherein the frame 26 of the food preparation table 10 is formed to have an L-shaped configuration when viewed from the vantage shown in FIG. 5A. This embodiment includes front and rear troughs 21, 21*a* along each side of the work surface 20 as shown in FIG. 5A. As in the other embodiment previously described, nozzles 23 may be positioned in either or both troughs 21, 21*a*. The troughs 21, 21*a* empty directly into a cavity 22, that is, this embodiment does not require a trough exit 24 to transport debris and/or fluid from the troughs 21, 21*a* to the cavity 22. Instead, the portions of the troughs 21, 21*a* immediately adjacent the cavity 22 function as a trough exit 24.

Another embodiment of the food preparation table 10 is shown in FIGS. 6A-8. This embodiment of the food preparation table 10 is similar to the embodiment shown in FIGS. 5A and 5B in its L-shaped design, but features storage compartments 25 positioned below the work surface 20 as previously described for the embodiment of the food preparation table 10 shown in FIGS. 2A, 2B, and 3. However, the embodiment in FIGS. 6A-8 includes different types of storage compartments 25 than those previously described, including a plurality of drawers wherein at least one drawer allows the user to control some of the parameters of the atmosphere in the interior of the drawer. This embodiment includes front and rear troughs 21, 21*a* with nozzles 23 oriented in the same manner as those previously described for the embodiment of the food preparation table 10 shown in FIGS. 5A and 5B. That is, the portions of the troughs 21, 21*a* immediately adjacent the cavity 22 function as the trough exit 24.

Figure 9A:
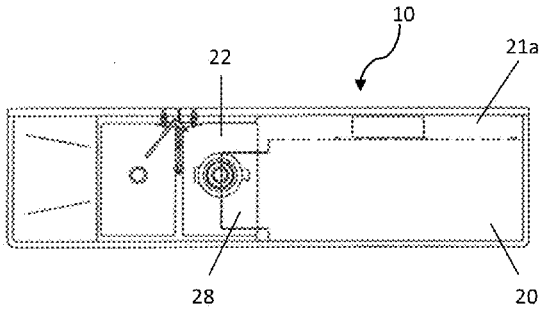
FIG. 9A is a schematic representation of an aerial view of a food preparation table having a work surface with a trough located to the rear of the work surface also with under-surface storage according to one embodiment.
Figure 9B:
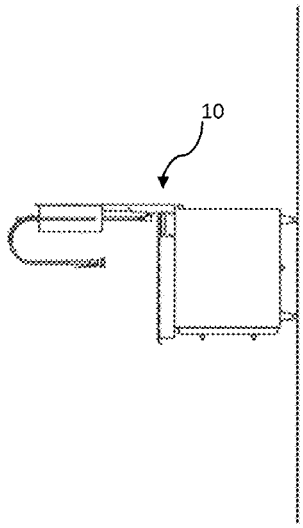
FIG. 9B is a schematic representation of a side-view of the food preparation table according to the embodiment of 9A.

Yet another embodiment of the food preparation table 10 is shown in FIGS. 9A and 9B. This embodiment features an extension 28 of the work surface 20 that aids the user by providing a portion of the work surface 20 directly above the cavity 22. The extension 28 increases the ease with which debris may be directed into the cavity 22 for disposal or later use. As with the embodiment shown in FIGS. 4A and 4B, the embodiment shown in FIGS. 9A and 9B includes a rear trough 21*a* located adjacent the rearward portion of the work surface 20. The portion of the rear trough 21*a* immediately adjacent the cavity 22 functions as a trough exit 24.

Figure 10:
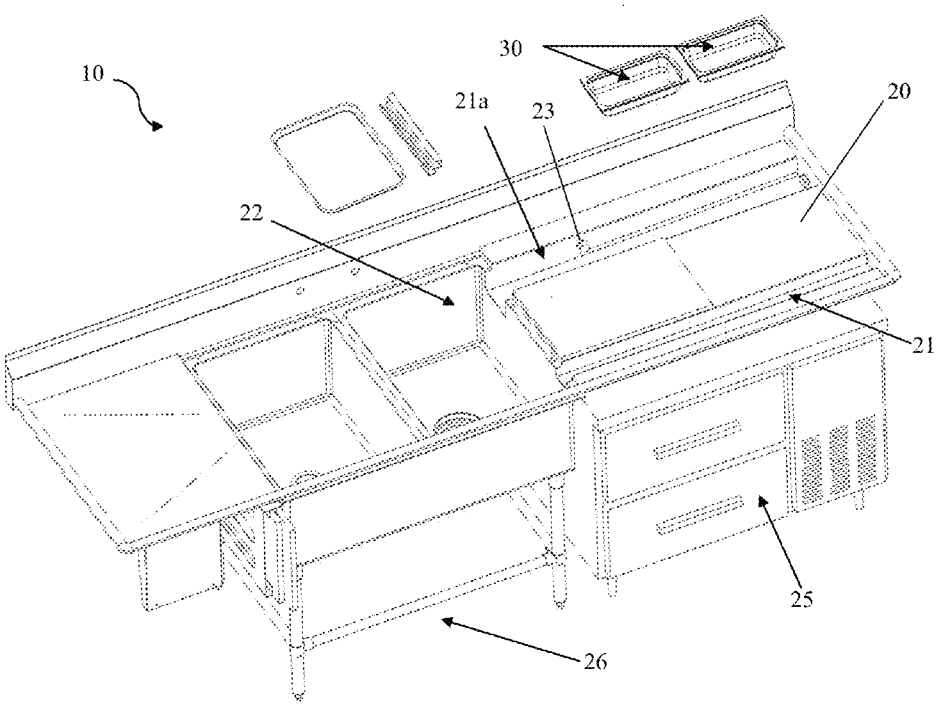
FIG. 10 is a schematic view of one embodiment of the food preparation table showing the use of receptacles in a trough.
Figure 11A:
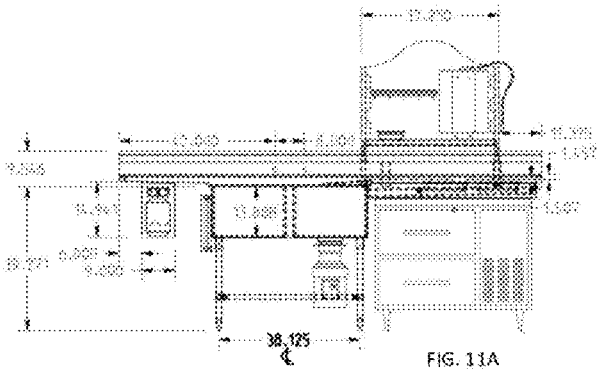
FIG. 11A is front view of the embodiment of the food preparation table shown in FIG. 10 with illustrative dimensions for various components of the food preparation table.
Figure 11B:
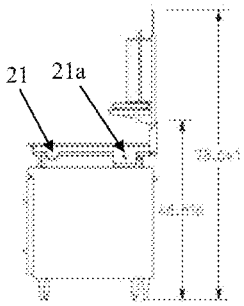
FIG. 11B is a side view of the embodiment of the food preparation table shown in FIG. 10 with illustrative dimensions for various components of the food preparation table.
Figure 11C:
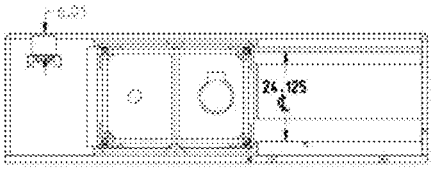
FIG. 11C is a top view of the embodiment of the food preparation table shown in FIG. 10 with illustrative dimensions for various components of the food preparation table.

FIG. 10 provides a perspective view of another embodiment of a food preparation table 10. In this embodiment, the rear trough 21*a* is sized to be wider and deeper than the front trough 21. Additionally, the rear trough 21*a* is configured so that receptacles 30 may be positioned in a portion of the rear trough 21*a*. It is contemplated that the receptacles 30 may be slid along the length of the rear trough 21*a*, and that any nozzles 23 will be positioned such that they do not interfere with the movement of a receptacle 30. Alternatively, the rear trough 21*a* may be configured without any nozzles 23. The receptacles 30 may be sized such that there is a predetermined clearance between the bottom of the receptacle 30 and the bottom of the rear trough 21*a*. The optimal value of this clearance will vary from one embodiment of the food preparation table 10 to the next, and the larger the debris that is positioned in the rear trough 21*a*, the higher it is contemplated that the optimal value will be. In most applications the optimal value will be between 0.1 and 3.5 inches. The front trough 21 may also be configured such that specifically sized receptacles 30 may be positioned therein and slid along the length thereof.

Figure 12:
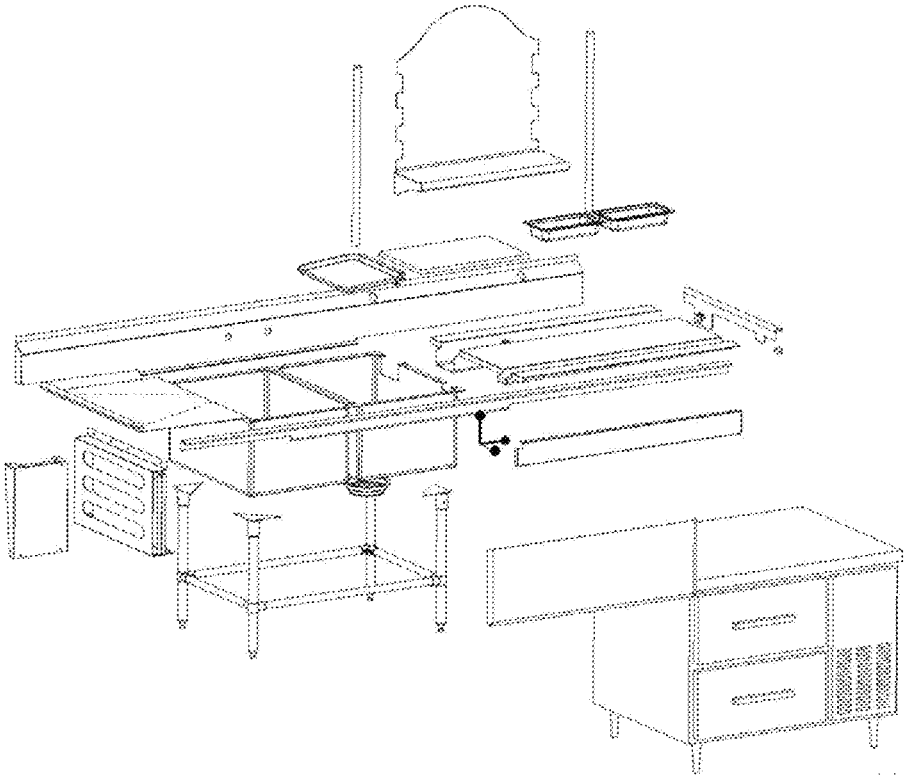
FIG. 12 is an exploded perspective view of the embodiment of the food preparation table shown in FIG. 10.

Illustrative dimensions for the various elements of the food preparation table 10 as shown in FIGS. 11A-11C, and FIG. 12 provides an exploded view of this embodiment of the food preparation table 10. As shown in FIG. 12, the various elements of the food preparation table 10 may be formed separately from one another and later assembled. This method of manufacture allows certain elements of the food preparation table 10 to be removed for replacement and/or repair without concern for other elements.

The optimal dimensions of the work surface 20, trough(s) 21, 21*a*, cavity 22, nozzle(s) 23 (if present), exit trough 24 (if present), storage compartment(s) 25 (if present), frame (26), extension 28 (if present), and receptacles 30 will vary from one embodiment of the food preparation table 10 to the next, and are therefore in no way limiting to the scope thereof.

The various elements of the food preparation table 10 may be formed of any material that is suitable for the application for which the food preparation 10 is used. Such materials include but are not limited to rubber, silicon, other polymers, metals, metallic alloys, cellulosic materials, and/or combinations thereof.

Having described several preferred embodiments, other features, advantages, and/or efficiencies of the food preparation table 10 will undoubtedly occur to those versed in the art, as will numerous modifications and alterations in the embodiments as illustrated herein, all of which may be achieved without departing from the spirit and scope of the food preparation table 10. It should be noted that the food preparation table 10 described herein is not limited to the specific embodiments pictured and described herein, but is intended to apply to all food preparation tables 10 employing at least one trough 21, 21*a* that may or may not use nozzles 23 to transfer debris to a cavity 22. Modifications and alterations from the described embodiments will occur to those skilled in the art without departure from the spirit and scope of a food preparation table 10 as described.

The invention claimed is:

1. A food preparation table comprising:

a. a support frame, wherein said support frame includes at least four legs oriented generally vertically, and wherein said support frame includes at least one horizontal member engaged with two of said at least four legs;

b. a work surface positioned on top of and supported by said support frame, wherein said work surface is flat, rectangular in shape, and lies within a generally horizontal plane, and wherein said work surface is configured for sanitary food preparation;

c. a front trough arranged along a first side of said work surface, wherein said first side of said work surface is defined as the front side, wherein a top edge of a first vertical wall of said front trough is collinear with a first edge of said work surface and is positioned in said generally horizontal plane, wherein a second vertical wall of said front trough is generally parallel to said first vertical wall and spaced apart therefrom, and wherein a top edge of said second vertical wall does not extend above said generally horizontal plane; and, d. a rear trough arranged along a second side of said work surface, wherein said second side of said work surface is defined as the rear side, wherein a top edge of a first vertical wall of said rear trough is collinear with a second edge of said work surface and is positioned in said generally horizontal plane, wherein a second vertical wall of said rear trough is generally parallel to said first vertical wall of said rear trough and spaced apart therefrom, wherein a top edge of said second vertical wall does not extend above said generally horizontal plane, wherein said rear trough is wider and deeper than said front trough.

2. The food preparation table as set forth in claim 1 further comprising:

a. a flushing system comprising at least one nozzle positioned in said trough, wherein said nozzle is affixed to said first or said second vertical wall;

b. means for delivering a fluid to said nozzle; and c. a controller for specifying the amount and rate that said fluid is expelled from said nozzle.

3. The food preparation table as set forth in claim 1 wherein the work surface is comprised of a rigid, waterproof, non-or-minimally porous heat resistant durable material.

4. The food preparation table as set forth in claim 1 wherein the work surface is comprised of injection molded food-grade plastic, which is anti-bacterial and sterilizable.

5. The food preparation table as set forth in claim 1 wherein the work surface is comprised of acrylic.

6. The food preparation table as set forth in claim 1 wherein the work surface is comprised of silicone.

7. The preparation table as set forth in claim 1 wherein the work surface is comprised of wood.

8. The food preparation table as set forth in claim 1 wherein the work surface is comprised of stainless steel.

9. A food preparation table comprising:

a. a support frame, wherein said support frame includes at least four legs oriented generally vertically, and wherein said support frame includes at least one horizontal member engaged with two of said at least four legs;

b. a work surface positioned on top of and supported by said support frame, wherein said work surface is flat, rectangular in shape, and lies within a generally horizontal plane, and wherein said work surface is comprised of a material that resists degradation when a cutting operation is performed on said work surface;

c. a front trough arranged along a first side of said work surface, wherein said first side of said work surface is defined as the front side, wherein a top edge of a first vertical wall of said front trough is collinear with a first edge of said work surface and is positioned in said generally horizontal plane, wherein a second vertical wall of said front trough is generally parallel to said first vertical wall and spaced apart therefrom, and wherein a top edge of said second vertical wall does not extend above said generally horizontal plane;

d. a rear trough arranged along a second side of said work surface, wherein said second side of said work surface is defined as the rear side, wherein a top edge of a first vertical wall of said rear trough is collinear with a second edge of said work surface and is positioned in said generally horizontal plane, wherein a second vertical wall of said rear trough is generally parallel to said first vertical wall of said rear trough and spaced apart therefrom, wherein a top edge of said second vertical wall does not extend above said generally horizontal plane;

e. a basin supported by said support frame and positioned adjacent said work surface, wherein said front trough and said rear trough drain into said basin;

f. a flushing system comprising at least one nozzle positioned in said trough, wherein said nozzle is affixed to said first or said second vertical wall;

g. a means for delivering a fluid to said nozzle; and h. a controller for specifying a volumetric flow rate that said fluid is expelled from said nozzle.

10. The food preparation table of claim 9 wherein said rear trough is wider and deeper than said front trough.

* * * * *